United States Patent [19]

Beuchel

[11] Patent Number: 5,024,559

[45] Date of Patent: Jun. 18, 1991

[54] PUNCH FOR USE IN A PELLET PRESS

[75] Inventor: Peter H. Beuchel, Columbia, S.C.

[73] Assignee: Westinghouse Electric Corp., Pittsburgh, Pa.

[21] Appl. No.: 486,231

[22] Filed: Feb. 28, 1990

[51] Int. Cl.[5] ..... B30B 11/02

[52] U.S. Cl. ..... 425/406; 249/135; 264/5; 425/408

[58] Field of Search ..... 75/236; 249/135

[56] References Cited

U.S. PATENT DOCUMENTS

| | | | |
|---|---|---|---|
| Re. 22,074 | 4/1942 | Schwarzkopf | 75/137 |
| Re. 22,166 | 8/1942 | Schwarzkopf | 75/137 |
| 1,721,416 | 7/1929 | Schröter | 75/236 |
| 1,973,428 | 9/1934 | Comstock | 75/1 |
| 2,122,157 | 6/1938 | Schwarzkopf | 75/136 |
| 3,451,791 | 6/1969 | Meadows | 29/182.8 |
| 3,480,410 | 11/1969 | Hummer | 29/182.8 |
| 3,647,401 | 3/1972 | Meadows | 29/182.8 |
| 3,660,050 | 5/1972 | Iler et al. | 29/182.8 |
| 3,677,722 | 7/1972 | Rymas | 29/182.8 |
| 3,734,489 | 7/1973 | Wentorf et al. | 51/307 |
| 4,013,460 | 3/1977 | Brown et al. | 75/204 |
| 4,127,411 | 11/1978 | Yajima et al. | 75/236 |
| 4,591,481 | 5/1986 | Lveth | 75/236 |
| 4,639,352 | 1/1987 | Kodama et al. | 75/236 |
| 4,731,349 | 3/1988 | Lee et al. | 264/65 |
| 4,851,041 | 7/1989 | Polizzotti et al. | 75/236 |

OTHER PUBLICATIONS

Mitsubishi Carbide Cat. No. 5110, p. 5.

*Primary Examiner*—Jay H. Woo
*Assistant Examiner*—William J. Matney, Jr.

[57] ABSTRACT

An apparatus for forming a pellet is disclosed that includes at least one punch that is reciprocably movable through an opening in a die for compressing a granular material, such as uranium dioxide, into a pellet such as the fuel pellets used in the fuel assemblies that generate power in nuclear reactors. The punch is advantageously formed from an alloy consisting essentially of tungsten carbide having a grain size of less than one micron which is embedded in a matrix of cobalt which constitutes between 16.5 and 17.5% by weight of the alloy. The alloy is preferably hot isostatically pressed to achieve zero porosity and a density of approximately 14.0 gm/cc$^3$. Additionally, essentially pure ingredients are preferably used to avoid interfaces in the resulting alloy which could provide situs for chipping. The resulting alloy has a Rockwell scale A hardness of 89.0, and results in a punch which, even when chamfered around its edges, is capable of producing a large number of uranium dioxide fuel pellets without chipping.

4 Claims, 4 Drawing Sheets

PUNCH FOR USE IN A PELLET PRESS

BACKGROUND OF THE INVENTION

This invention generally relates to devices for forming pellets, and is specifically concerned with a punch that compresses granular uranium dioxide into fuel pellets for use in the fuel rods of nuclear fuel assemblies.

Devices for compressing granular materials into pellets are well known in the prior art. Such devices are used to compress granular uranium dioxide into pellets which are stacked into the fuel rods used in the nuclear fuel assemblies that generate heat for converting water into pressurized steam in the core of a nuclear reactor. Such pellet-forming devices typically comprise a punch that is reciprocably movable within an opening in a die. In the devices used to form uranium dioxide fuel pellets, a pair of opposing punches are reciprocably movable throughout opposing openings in a die. In operation, a quantity of granular uranium dioxide is poured into the opening in the die, and, the two opposing punches then compress the powder on either end to form a cylindrical pellet. The pellets are then ejected from the die for further processing.

Within the last few years, the Commercial Nuclear Fuel Division of the Westinghouse Electric Corporation modified its pellet-forming devices to create a chamfer around the edges of the resulting pellets. Such chamfering (which gives the ends of the cylindrical pellets a frusto-conical edge) advantageously reduces the amount of chipping or cracking which may occur at the upper and lower ends of the pellets when the fuel rods which contain them are flexed or otherwise bent by, for example, cross currents in the water that surrounds them during operation. However, in order to achieve such pellet-chamfering, the edges of the substantially flat-faced punches which form the pellet ends had to be chamfered in a complementary manner, which had the effect of providing a sharp, raised edge around each punch. Unfortunately, the provision of such a chamfered edge around the circular face of the punches created an area of localized stress when the punch was momentarily pressed against a trapped quantity of granular uranium dioxide in order to form a hard and substantially non-porous pellet. The applicant has found that such localized stresses around the outer edges of the punches can cause these punches to chip in these areas, which in turn necessitates replacement of the punch. This is a costly shortcoming of such punches, as each punch is a precision tool of significant expense, and further, as each replacement operation holds up production of uranium dioxide fuel pellets.

In an attempt to eliminate or at least reduce the amount of chipping that occurred around the chamfered edges of such punches, the applicant increased the punch toughness by first increasing the particle size of the tungsten carbide particles used in the alloy. This, however, did not have the intended results. Accordingly, a further attempt was made wherein the diameter of the tungsten carbide particles was reduced to less than one micron, and the cobalt content was increased from 8% to approximately 15%. While these changes did significantly increase the toughness of the punch and reduce chipping around the chamfered edges of the punches, it did not completely eliminate such chipping.

Clearly, what is needed is an improved punch having a chamfered edge for use in a pellet forming device which is completely immune from chipping around its chamfered edges. Ideally, such a punch should be fairly easy to fabricate, and further characterized by long life and reliable operation.

SUMMARY OF THE INVENTION

Generally speaking, the invention is an apparatus for forming a pellet that comprises at least one punch that is reciprocably movable through an opening in a die for compressing a granular material, such as uranium dioxide, into a pellet, the punch being formed from an alloy including tungsten carbide and cobalt, wherein cobalt constitutes over 15% but under 18% of the alloy by weight. The grain size of the tungsten carbide is preferably less than one micron, and the entire alloy is hot isostatically pressed after sintering to achieve zero porosity and a density of 14 gm/cc. The applicant has observed that such an alloy advantageously has a Rockwell scale A hardness of 89.0±1.15. In the preferred embodiment, essentially pure tungsten carbide and cobalt is used to avoid the creation of impurity interfaces in the resulting punch which could provide situs for chipping. Ideally, the cobalt constitutes between about 16.5 to 17.5% by weight of the alloy.

When the previously described alloy is used to form a punch having an essentially flat face that is circumscribed by a raised chamfer, the strength and hardness of the resulting alloy helps to prevent chipping from occurring in the area of the chamfer.

BRIEF DESCRIPTION OF THE SEVERAL FIGURES

DETAILED DESCRIPTION OF THE PREFERRED EMBODIMENT

Figure 1:
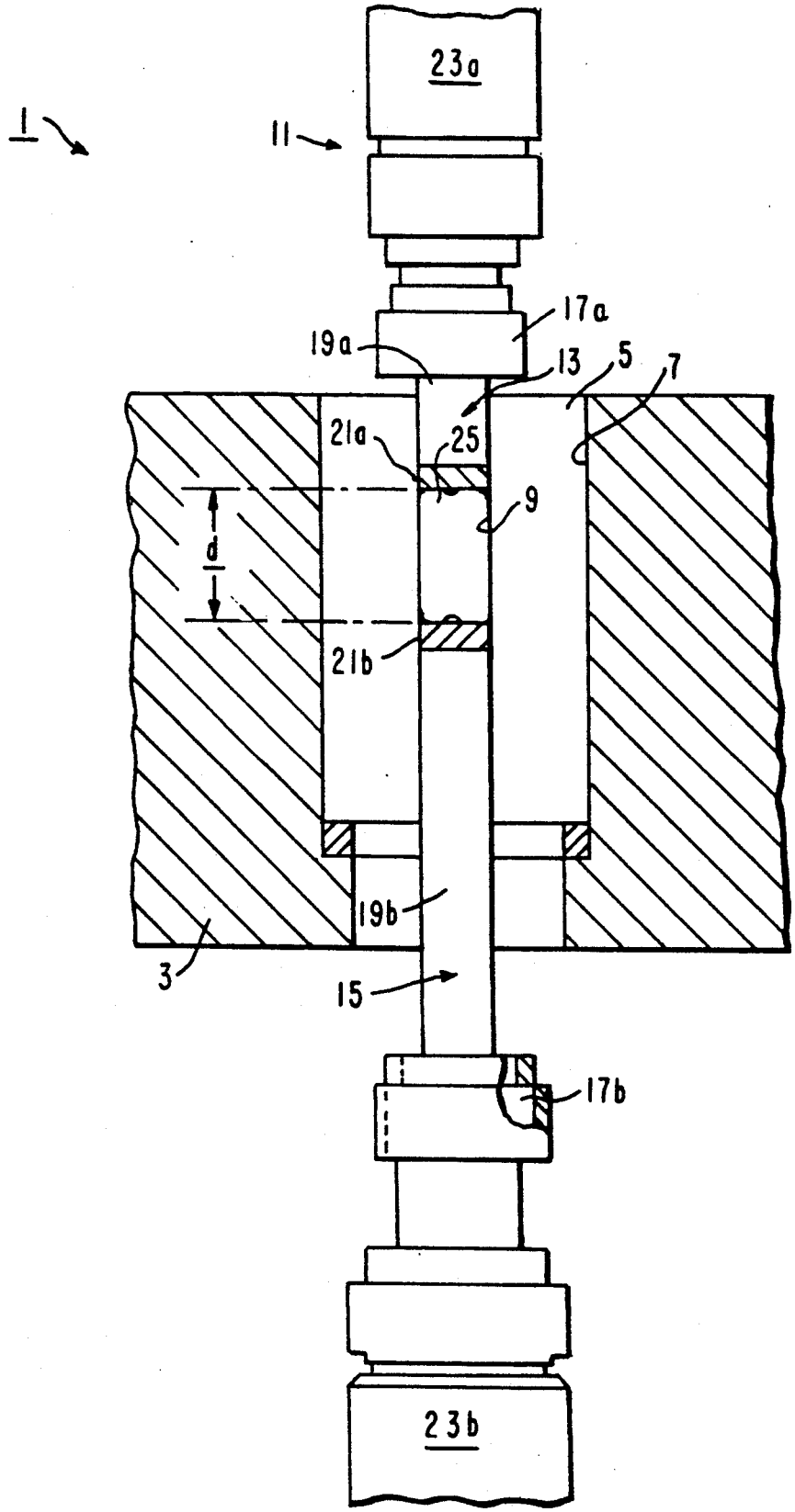
FIG. 1 is a cross-sectional side view of the type of rotary pellet press assembly that the invention is used in connection with, illustrating both the upper and lower punches used to form a pellet of uranium dioxide.

With reference now to FIG. 1, wherein like numbers designate like components throughout all the several figures, the invention is a rotary pellet press assembly 1 having an improved punch, which will be described in detail hereinafter. Such pellet press assemblies 1 generally comprise a rotatable table 3 having a plurality of dies 5 arranged in a circle. Each die 5 is mounted in a cylindrical opening 7 in the table 3, and further includes a cylindrical bore 9 that is concentrically aligned with is axis of rotation. The pellet press assembly 1 further includes a number of pressing stations 11, each of which includes an upper punch assembly 13, and a lower punch assembly 15. Each of the punch assemblies 13,15 in turn includes a birthday-cake shaped base 17 on its proximal end, a shank 19 in its middle portion and a punch 21 on its distal end. The base 17 and shank 19 are each preferably formed from tool steel, while the punch 21 that caps the distal end of each of the assemblies 13,15 is formed from an alloy of tungsten carbide and cobalt. The punches 21*a, b* are affixed to the ends of their respective shanks 19*a, b* by brazing. The birthday-cake shaped bases 17*a, b* of the upper and lower punch assemblies 13,15 are coupled to punch assembly holders 23*a,b*.

In operation, the table 3 is mounted so that it is rotatable relative to the pressing stations 11. The upper punch assembly 13 of one of the stations 11 is retracted out of the cylindrical bore 9 of the die 5. A quantity of uranium dioxide powder is next poured into the cylindrical bore 9. The die 5 is then rotated into registry with the upper punch assembly 13. Both the upper and the lower punch assemblies are then simultaneously extended into the cylindrical bore 9 of the die in order to compress the uranium dioxide powder into a fuel pellet 25 for use in a nuclear fuel assembly. The momentary stresses experienced by the punches 21 is substantial during the pressing step of the operation, as both punches 21 operate at a combined pressure force of about 6,000 kg, which in turn squeezes the pellets 25 to a density of somewhere between 5.9 and 6.4 grams per cubic centimeter.

Figure 2:
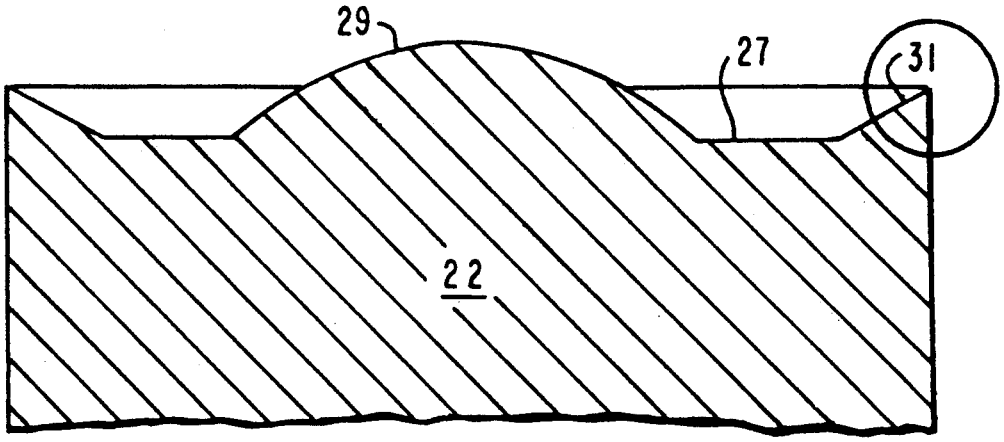
FIG. 2 is a cross-sectional side view of the punch of the invention, illustrating the details of the front face thereof.
Figure 3:
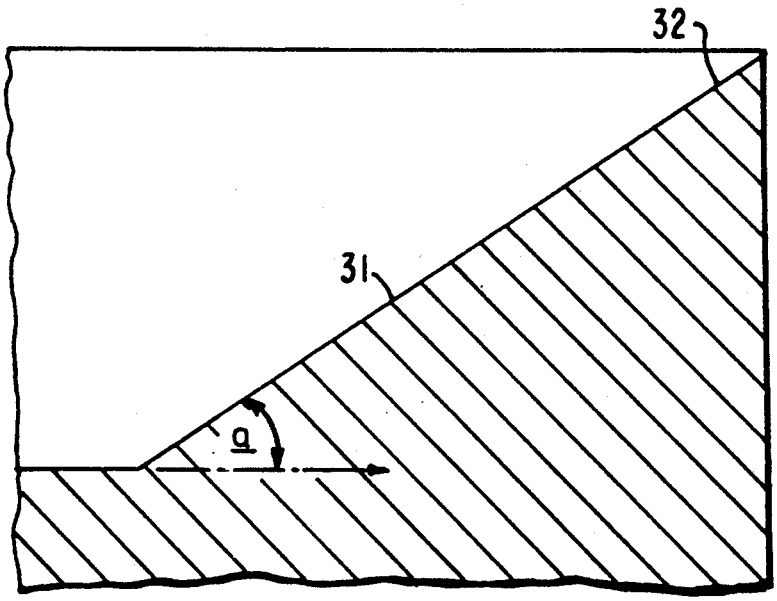
FIG. 3 is an enlargement of the edge of the punch enclosed in a circle in FIG. 2, illustrating the shape of the chamfered edge that circumscribes the punch of the invention.

With reference now to FIGS. 2 and 3, each punch 21 has a substantially planar front face 27 characterized by a dish portion 29 in its center, and a chamfered edge 31. The purpose of the dish portion 29 is to emboss a slight depression into the ends of the resulting uranium dioxide pellet 25 into which gases created by the fission process may congregate when the pellets 25 are stacked in tandem within a fuel rod. The purpose of the chamfered edge 35 is to create a beveled edge around both ends of the resulting uranium dioxide pellet 25 which is less apt to flake or to chip when the pellets 25 are stacked with a fuel rod and the fuel rod is then flexed. In the preferred embodiment, the angle a of the chamfered edge 31 is somewhere between 10 and 14 degrees with respect to the substantially planar face 27 of the punch 21.

In the past, the momentary stresses applied to the chamfered edge 31 from the application of the 6,000 kg force thereto has resulted in chipping, particularly along the upper portion 32 of the chamfered edge 31. Such chipping often leaves scalloped-shaped depressions around the upper portion 32 of the chamfered edge 31. These scalloped-shaped depressions necessitate the replacement of the entire punch assembly 13,15, as the pellets 25 produced by such chipped punches have an unacceptably rough texture at their ends which in turn promotes the very flaking and chipping of the pellet 25 which the provision of the chamfered edge 31 seeks to avoid.

To avoid the problems associated with the prior art, the applicant forms the punch 21 of each of the punch assemblies 13,15 out of a novel alloy formed from a mixture of tungsten carbide having a grain size of less than one micron and cobalt which constitutes between 16.5 and 17.5 (preferably 17%) by weight of the resulting mixture. The alloy is then preferably sintered and then hot isostatically pressed to achieve zero porosity with a density of approximately 14.0 grams per cubic centimeter. Essentially pure ingredients are used to avoid interfaces within the alloy which could provide a situs for chipping. The resulting alloy has a surprisingly high Rockwell A scale hardness of 89.0, and the resulting punch is capable of producing a large number of uranium oxide fuel pellets 25 without chipping anywhere on its face 27. Thus, not only is the resulting alloy surprisingly hard, but further surprisingly high in its fracture toughness.

Figure 4:
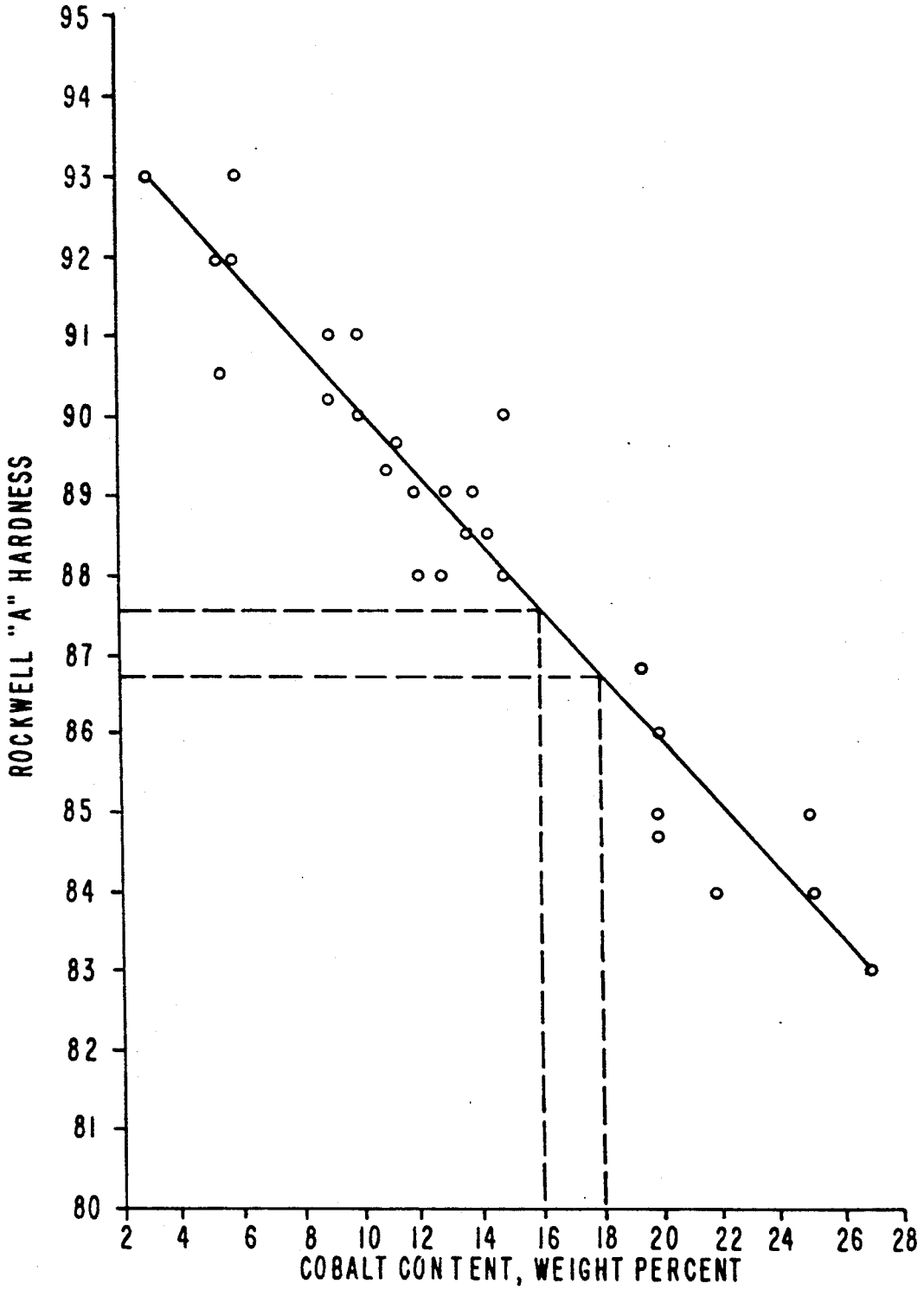
FIG. 4 is a graph illustrating how Rockwell A hardness may be expected to vary with the cobalt content of a tungsten carbide material.
Figure 5:
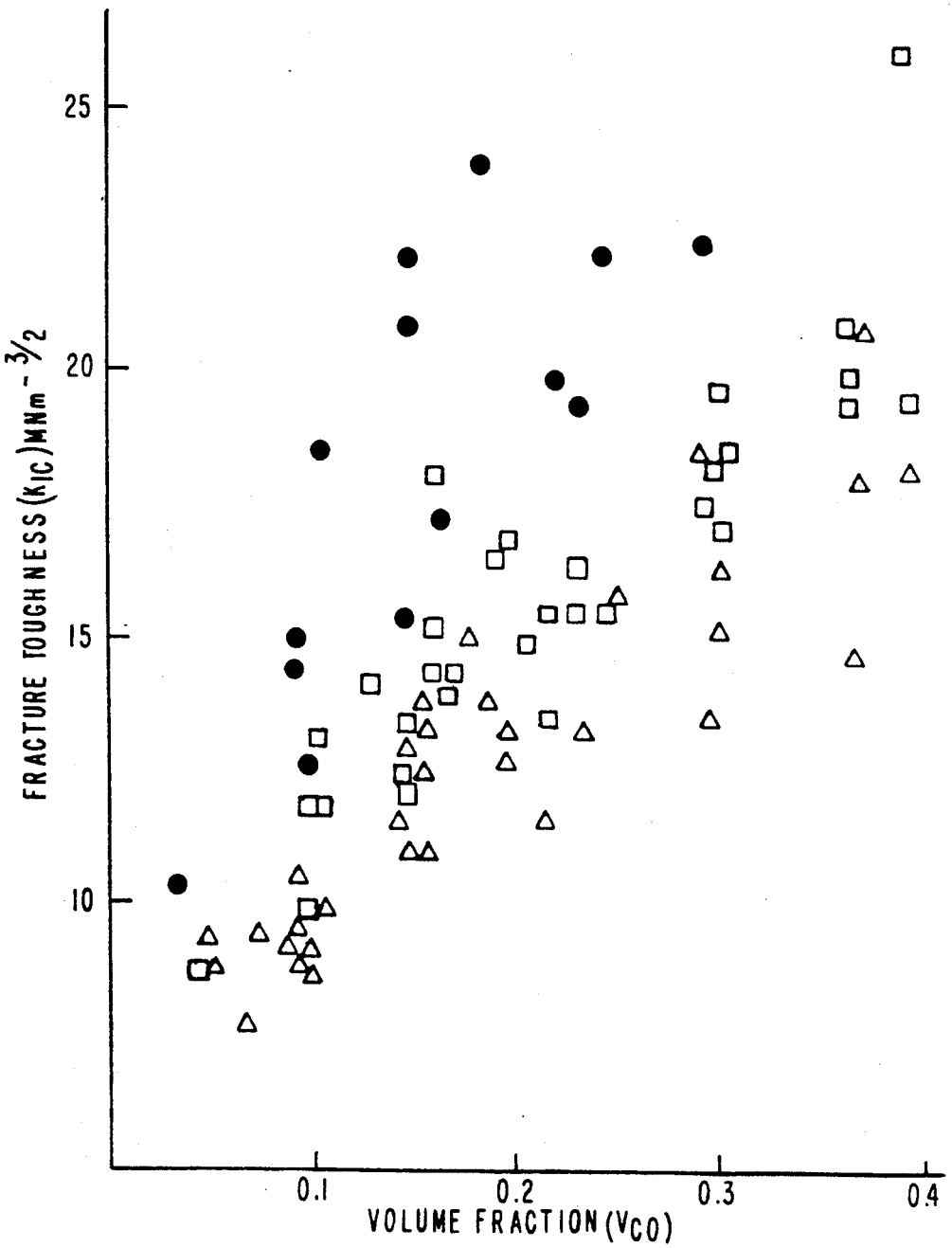
FIG. 5 is a graph illustrating how the fracture toughness of a tungsten carbide material varies with both the volume fraction of cobalt, and the carbide particle size.

FIGS. 4 and 5 illustrate why the resulting Rockwell A hardness and high fracture toughness of the resulting alloy are surprising. Specifically, the graph in FIG. 4 is a regression analysis of empirical data compiled by the research and development personnel of the Westinghouse Electric Corporation prior to the discovery of the chip-resistant tungsten carbide alloy by the applicant. This particular graph illustrates the Rockwell A hardness associated with the tungsten carbide alloys having various weight percentages of cobalt. At the time that this graph was compiled, no sample points were available for a tungsten carbide alloy having between 16 and 18 weight percent cobalt. According to the linear regression analysis generated by the sample points available at that time, the Rockwell A hardness associated with such an alloy having between 16 and 18 per cent weight cobalt should have been about $87.1 \pm 0.4$. By contrast, the actual Rockwell A hardness was found to be $89.0, \pm 1.5$. This unexpectedly higher hardness factor translates into a very practical advantage in the punch 21 of the invention, as it provides a punch 21 which is much less apt to wear out or to lose its outer diameter dimensional tolerances as a result of rubbing against the cylindrical bore 9 of the die 5. This, in turn, means that the punches 21 formed from such an alloy have long life spans.

FIG. 5 illustrates still another surprising aspect of the alloy used to form the punch 21 of the invention. FIG. 5 plots a number of sample points wherein fracture toughness has been measured for tungsten carbide alloys having varying volumes of cobalt, i.e., between 10 percent and 40 percent cobalt by volume. The triangular sample points indicate measurements that were made on alloys wherein the tungsten carbide particle size is less than 1.25 microns, wherein the squares and the dark circles indicate sample points wherein this particle size was between 1.25 and 3.75 microns, and over 3.75 microns, respectively. From this graph, if one considers the sample points wherein the cobalt content was between 10 and 20 percent, it appears that greater toughness is achieved when the tungsten carbide particle size was relative large (i.e., larger than 3.75 microns). However, the applicant has surprising and empirically found that while fracture toughness may well increase when the particle size of the tungsten carbide used is over 3.75 microns, that resistance to chipping actually decreases with such larger particle size. Stated another way, the applicant has surprisingly found that resistance to chipping (which was thought, in the prior art, to parallel fracture toughness) is actually greater when the particle sizes of the tungsten carbide are small, i.e., less than one micron. Thus, the data recorded in the graph illustrated in FIG. 5 are directly at odds with the applicant's invention, and in fact teach away from it.

In short, a surprisingly hard and chip-resistant punch 21 is formed when the punch is fabricated out of an alloy consisting essentially of substantially pure tungsten carbide particles less than one micron in diameter mixed with between 16 and 18 weight percent of cobalt which mixture is sintered and then hot isostatically pressed to achieve zero porosity. To avoid interfaces which could interfere with the fracture toughness of the alloy, the alloy should contain less than one percent by weight of impurities.

Additionally, a tungsten carbide grain size of 0.8 microns is preferred, and the resulting alloy should be sintered at about 1000 degrees Centigrade before being hot isostatically pressed to the desired density to remove all porosity.

I claim:

1. An apparatus for producing substantially uniform cylindrical uranium dioxide pellets with frusto-conical beveled ends useful for forming nuclear reactor fuel, said apparatus comprising a pair of reciprocating punch means for compressing and shaping granular uranium dioxide into said frusto-conical beveled end cylindrical pellets, each said punch means including a substantially flat face with a chamfered circumferential edge, wherein said face and said chamfered edge are formed from a substantially chip resistance alloy consisting essentially of substantially pure tungsten carbide having a grain size of less than one micron and 16.5 to 17.5% by weight cobalt and said substantially chip resistant alloy is substantially devoid of impurity interfaces.

2. The apparatus described in claim 1, wherein said alloy has a density of about 14.0 g/cc and substantially zero porosity.

3. The apparatus described in claim 1, wherein said alloy has a Rockwell A hardness of 87.5 to 90.5.

4. The apparatus described in claim 1, wherein said tungsten carbide grain size is 0.8 microns and said cobalt is 17% by weight.

* * * * *